United States Patent [19]

Szlucha et al.

[11] 4,336,992

[45] Jun. 29, 1982

[54] APPARATUS FOR REMOVING COPY SHEETS FROM A ROLL FUSER

[75] Inventors: Thomas F. Szlucha, Fairport; Clifford O. Eddy, Webster, both of N.Y.

[73] Assignee: Xerox Corporation, Stamford, Conn.

[21] Appl. No.: 150,767

[22] Filed: May 19, 1980

[51] Int. Cl.[3] ..... G03G 15/00

[52] U.S. Cl. ..... 355/3 FU; 271/311; 271/DIG. 2; 355/3 SH; 432/60

[58] Field of Search ..... 355/3 R, 3 FU, 3 SH; 432/60, 228; 271/307, 308, 311, 312, DIG. 2

[56] References Cited

U.S. PATENT DOCUMENTS

| | | | |
|---|---|---|---|
| 746,124 | 12/1903 | Mosher | 271/307 |
| 3,649,115 | 3/1972 | Hodges | 355/3 R X |
| 3,844,252 | 10/1974 | Thettu | 432/60 X |

FOREIGN PATENT DOCUMENTS

| | | | |
|---|---|---|---|
| 705411 | 12/1979 | U.S.S.R. | 355/3 FU |

*Primary Examiner*—Fred L. Braun

[57] ABSTRACT

A heat and pressure roll fusing apparatus for fixing toner images to copy substrates, the toner being made of a thermoplastic resin. The apparatus includes an internally heated fuser roll cooperating with a back-up or pressure roll to form a nip through which the copy substrates pass with the images contacting the heated roll. The heated fuser roll is characterized by an outer layer or surface which by way of example is fabricated from silicone rubber. Sheet removal or supporting member in the form of flexible finger structures are provided. The fingers contact the surface of the heated fuser roll and therefore are constructed so as to preclude damage to the soft fuser roll surface should they tend to gouge it. In operation the fingers are sufficiently flexible so that when a misstrip occurs they can be deflected out of contact with the fuser roll and partially rotated thereby. Each finger structure may have either a single finger or two fingers. The fingers are mounted for 360° of rotation partially by the heated fuser roll and, in part, manually.

4 Claims, 3 Drawing Figures

APPARATUS FOR REMOVING COPY SHEETS FROM A ROLL FUSER

BACKGROUND OF THE INVENTION

This invention relates generally to xerographic copying methods and apparatus, and more particularly, it relates to the heat and pressure fixing of particulate thermoplastic toner by direct contact with a heated fusing member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated.

As the copy sheet passes out of the nip formed by the fuser roll and the back-up roll, it is necessary to provide means such as an air stripper, stripper blades, finger-like members or other suitable sheet separating means to insure that the copy paper proceeds along a predetermined path from the nip formed between the fuser roll and back-up roll to a conveyor belt or the like for moving the copy paper towards the exit of the machine or apparatus in which the fuser is employed.

In a soft roll fuser where the silicone rubber or other such material forming the outer surface or layer of the fuser roll is relatively (i.e. 50 mils or greater) thick an air stripper is used to assist self-stripping which is brought about by the flexing of the rubber as it moves through the nip area. Where the outer surface is relatively thin an air device is the primary stripping mechanism. Air or noncontact stripping is preferred for use with a soft roll fuser because the soft surface can be easily damaged by conventional contact stripper fingers. However, air stripping is a relatively costly addition to a copier or duplicator machine where the machine does not have an existing air compressor which could be employed for this additional function. Some machines have been known to utilize an air compressor for effecting pressure engagement of fuser rolls. In such a machine the incremental cost of air stripping would be acceptable.

In a machine having a soft fuser and a contact stripper special care must be taken in the structuring of the stripper mechanism such as fingers in order to prevent or minimize damage to the soft roll surface. Damage from the stripper fingers can occur when there is a misstrip. A misstrip takes place when the force required to strip a toner laden sheet from the fuser roll exceeds the force available with the stripper finger structure used. Very often due to a misstrip, the paper forces the fingers to gouge the soft surface of the roll.

Prior art sheet removal devices are known which are designed to preclude or minimize the damaging of fuser roll surfaces. One such device is illustrated in U.S. Pat. No. 3,844,252 and comprises a finger structure having a tip portion which rides on the surface of the fuser roll and acts to remove the sheets therefrom. The opposite end of the finger is bifurcated for receiving a spring clip. The clip adjacent the open end of the bifurcated area has a pair of detents for receiving a pivot pin on which the finger is mounted. The rest of the clip comprises an open area into which the pivot pin can move as will be explained hereinafter. Upon the occurrence of a sheet misstrip or jam condition, whereby the finger is caused to exert undue pressure against the roll surface, the finger is forced back against the holding pressure of the pivot pin with sufficient pressure to cause the pin to be released from the detent and move into the open area thus allowing the finger to move away from the fuser roll. The finger is thus permitted to fall away from the roll surface to an inoperative position.

Stripper fingers such as those described in the above-mentioned patent work quite well in minimizing fuser roll damage. However, such stripper fingers require resetting, usually by a qualified technical person. Simply clearing the paper jam by removal of the misstripped sheet by a non-technical person will not render the machine operative again.

Accordingly, it is intended by means of the present invention to provide an improved contact sheet removal apparatus or guide comprising one or more stripper finger structures for use with a soft roll fuser which minimizes the hazard of damage to the soft outer layer of the fuser roll because under adverse conditions it is deflected out of contact with the fuser roll surface. The finger structure is designed to be readily repositioned to an operative position after the removal of a misstripped sheet of paper.

BRIEF SUMMARY OF THE INVENTION

The invention comprises a thin flexible reinforced plastic separating or stripping finger or finger-like structure which can be deflected out of contact with the fuser roll when the required separating forces exceed the stripping fingers' capability for stripping. In this manner, the stripper finger yields to excessive stripping forces rather than the surface of the roll being gouged. The finger is rotatably mounted for rotation through 360° so that when the finger is deflected by the roll it rotates with the further rotation of the fuser roll until it moves past the roll and no longer contacts it. When this condition exists all that is required to render the fuser operable is to remove the copy sheet causing the jam and manually rotate the finger through the remainder of the 360° in the same direction as that caused by the fuser roll.

The finger structure may comprise either a single finger which is rotatably supported adjacent one end thereof or it may comprise a pair of fingers aligned in the same plane and rotatably supported intermediate the two fingers.

DETAILED DESCRIPTION OF THE DRAWINGS

DETAILED DESCRIPTION OF THE PREFERRED EMBODIMENT OF THE INVENTION

Figure 1:
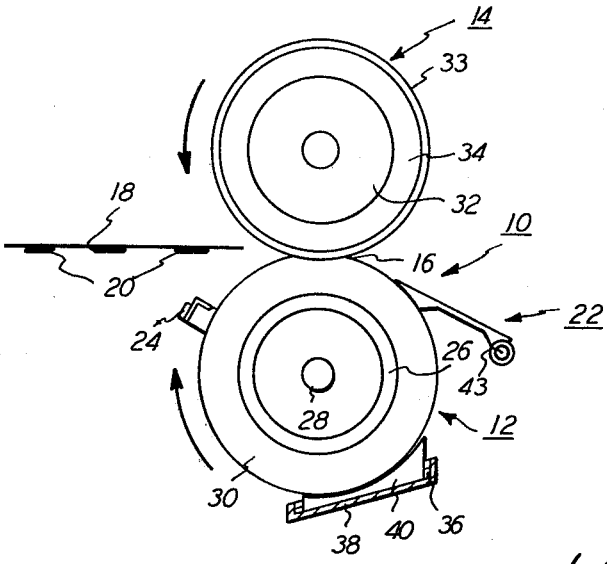
FIG. 1 is a side elevational view of a roll fuser apparatus incorporating a finger structure according to the invention.

Referring now to the figures, it can be seen that the invention is directed to a roll fuser apparatus generally indicated 10. The fuser apparatus comprises a heated roll structure 12 cooperating with a non-heated back-up roll structure 14 to form a nip 16 through which a copy substrate 18 passes with toner images 20 formed thereon in a well known manner. The toner images 20 contact the heated roll structure while a force is applied between the roll structures in a well known manner to create pressure therebetween resulting in the deformation of the fuser roll structure by the back-up roll structure to thereby form the nip 16.

As the substrate passes out of the nip, it is stripped or separated from the heated roll structure such stripping being assisted by a plurality (only one shown) of contact stripping devices or apparatuses 22 after which it is free to move along a predetermined path toward the exit of the machine (not shown) in which the fuser apparatus 10 is to be utilized. The stress in the surface of the fuser roll structure as it passes through the nip area facilitates the removal of the copy sheets by the contact stripping devices.

A contact temperature sensor 24 is provided for sensing the surface temperature of the roll structure 12 and in conjunction with conventional circuitry (not shown) maintains the surface temperature to a predetermined value, for example, on the order of 375°-400° F.

The heated roll structure 12 comprises a hollow cylinder 26 having a radiant quartz heater 28 disposed in the hollow thereof. When suitably energized via the aforementioned circuitry, the heating element radiates heat to the cylinder which is then conducted to the outer surface of an outer layer 30 of the structure 12 which preferably comprises silicone rubber having a thickness on the order of 50 mils.

The back-up roll structure 14 comprises a solid metal core 32 to which is adhered a layer 34 of deformable material for example an elastomer known as ethylene-propylene terpolymer which is based on stereosperific linear typolymers of ethylene, propylene and small amounts of non-conjugated diene which is commonly referred to as EPDM which layer carries a thin overcoat 33 of PFA (a trademark of E. I. duPont). Due to the construction of the back-up roll structure it is harder than the fuser roll structure and therefore it deforms the surface of the heated roll structure when the required pressure is applied therebetween, the pressure being a function of the desired deformation which corresponds to the desired length of the nip 16.

While the layer 30 tends to be abhesive, therefore, exhibits a low affinity for the toner material 20, it has been found desirable to coat the layer with a release agent material 36 contained in a pan 38. The material 36 comprises a liquid polymeric release agent, for example, silicone oil. The silicone oil is supplied to the pan via a pump and suitable conduit (not shown) from where it is conveyed to the surface of the fuser roll structure by a wick 40.

Figure 2:
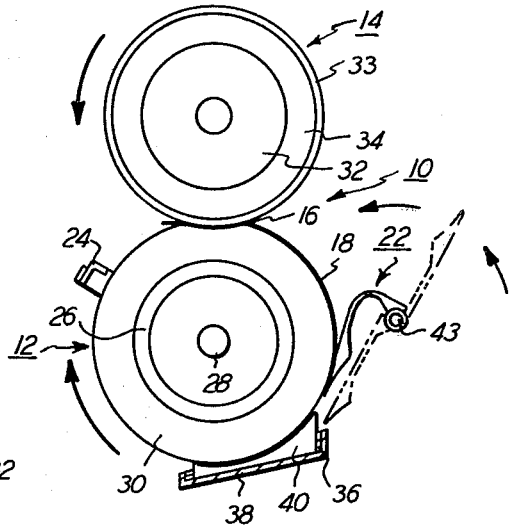
FIG. 2 is a view similar to FIG. 1 but with a paper jam condition illustrating how the finger is deflected under such conditions.

A plurality of the stripping or separating members 22 (only one shown) are rotatably supported by a stationary shaft 43. The members 22 are preferably fabricated from a reinforced plastic material such as polyester resin containing approximately 20% by weight of carbon or glass fiber. The members 22 are rotatably supported by stationary shaft 43 such that they can be rotated by way of example through an angle of 360° counterclockwise such rotation being brought about partially by rotation of the heated fuser roll member and, in part, manually. To this end, the cross section of the member 22 is sufficiently thin as to render it flexible enough to be deflected by the fuser roll upon the occurrence of a paper jam as shown in FIG. 2. The heated fuser roll will cause the member to be partially rotated as well as deflected out of contact with the roll surface. Once a paper jam has occured, the paper is removed and member 42 is manually rotated to its operative position, therefore in contact with the fuser roll surface.

Figure 3:
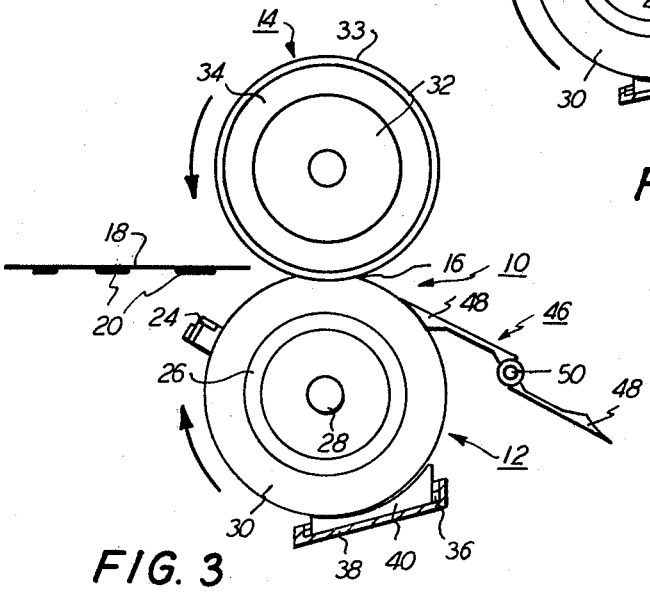
FIG. 3 is a side elevational view of a roll fuser apparatus including a modified form of the finger structure illustrated in FIG. 1.

A modified form of the member 22, as illustrated in FIG. 3, comprises a plurality of separating members 46 (only one shown) each of which includes a pair of integral fingers 48 disposed 180° apart and supported by a stationary shaft 50.

We claim:

1. In a roll fuser apparatus comprising a deformable fuser roll and a heat source for elevating the surface temperature thereof, said fuser roll cooperating with a backup roll to form a nip through which copy sheets carrying toner images pass with the images contacting the heated fuser roll, and further comprising apparatus for separating said sheets from said heated fuser roll, the improvement comprising:

at least one flexible stripper member supported in contact with said heated fuser roll;

a stationary support shaft supporting said stripper member for 360° of rotation about said shaft and supporting said at least one flexible stripper member radially immovable with respect to said shaft, said at least one flexible stripper member being sufficiently flex ible whereby it can be deflected by said heated fuser roll and rotated thereby through a portion of said 360° and moved ou t of contact with said heated fuser roll, said stripper member being adapted to be manually rotated through the remaining portion of said 360° whereby it again contacts the surface of said heated fuser roll.

2. Apparatus according to claim 1 wherein said at least one stripper member comprises a finger-like structure.

3. Apparatus according to claim 1 wherein said at least one stripper member comprises a pair of finger-like structures.

4. Apparatus accordidng to claim 3 wherein said pair of finger-like structures form an integral structure wherein they are disposed in a straight line and pivotally supported intermediate thereof.

* * * * *